United States Patent [19]

Jessee

[11] 3,992,011

[45] Nov. 16, 1976

[54] HEADS DOWN GOLF PRACTICE DEVICE

[75] Inventor: Karl E. Jessee, Huntington Beach, Calif.

[73] Assignee: Active Enterprises, Inc., Huntington Beach, Calif.

[22] Filed: Oct. 30, 1975

[21] Appl. No.: 627,122

[52] U.S. Cl. ..... 273/183 A; 273/183 E; 273/195 R; 273/184 R; 273/186 C

[51] Int. Cl.[2] ..... A63B 69/36

[58] Field of Search ..... 273/183 R, 183 A, 183 E, 273/179 A, 26 A, 184 R, 184 B, 195 R, 186 R, 186 B, 186 C

[56] References Cited

UNITED STATES PATENTS

| | | | |
|---|---|---|---|
| 1,596,110 | 8/1926 | Lynch | 273/183 A |
| 3,365,199 | 1/1968 | Scholin et al. | 273/179 A |
| 3,436,076 | 4/1969 | Barthol | 273/183 R X |
| 3,897,059 | 7/1975 | McCulloch | 273/179 A |

*Primary Examiner*—George J. Marlo
*Attorney, Agent, or Firm*—Charles A. Goodall

[57] ABSTRACT

A Heads Down Golf Practice Device having a resilient tubular golf tee member mounted in and protruding upwardly from a resilient, flat tee support structure base. The base includes a light emitting assembly having a light visible through the tee interior portion of the resilient tubular golf tee and mechanical indexing elements for randomly selecting a color of the visible light. The support structure is placed in front of a golfer on a relatively flat surface in a desired location, a golf ball is placed on the tubular tee thereby covering the light which is otherwise visible through the tee interior at the tee top, a color is randomly selected by the golfer and the golfer swings his golf club striking the ball setting it in flight and observes the light color after the ball is struck and the club passes over the tee, if the golfer's shoulders, head and eyes are positioned correctly the instant the golf club strikes the ball and passes over the tee.

10 Claims, 12 Drawing Figures

FIG. 1
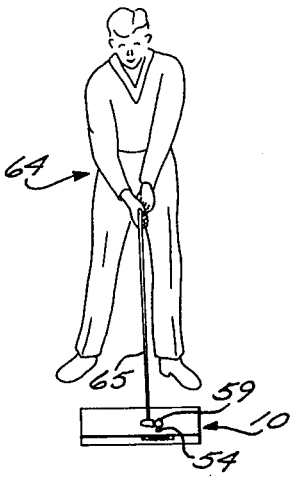
FIG. 2
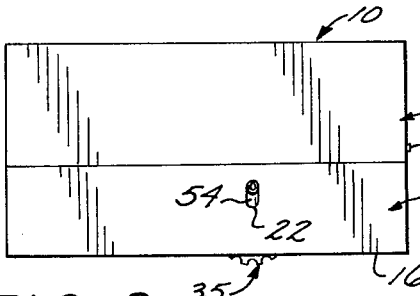
FIG. 3
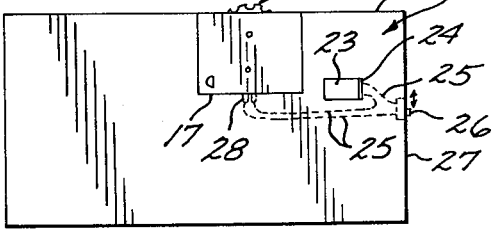
FIG. 7
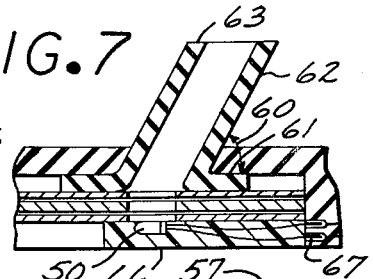
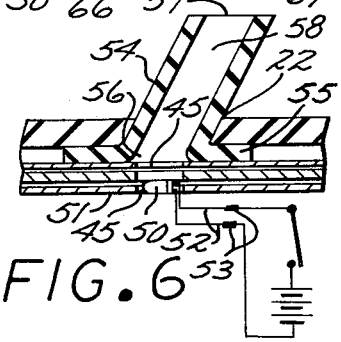
FIG. 6
FIG. 4
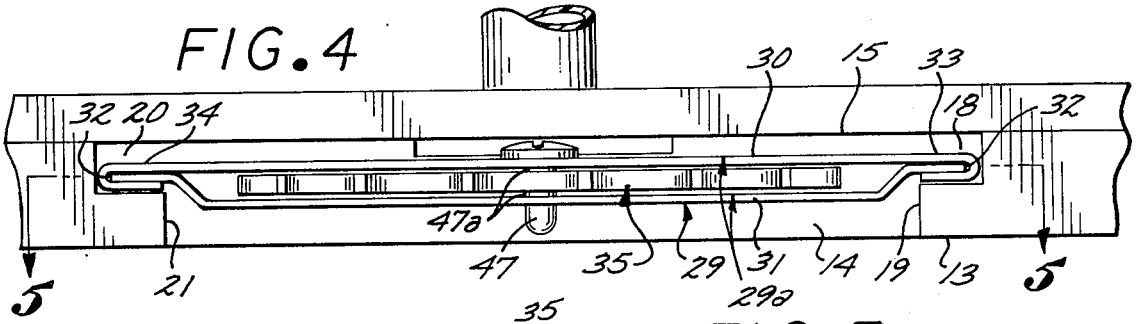
FIG. 5
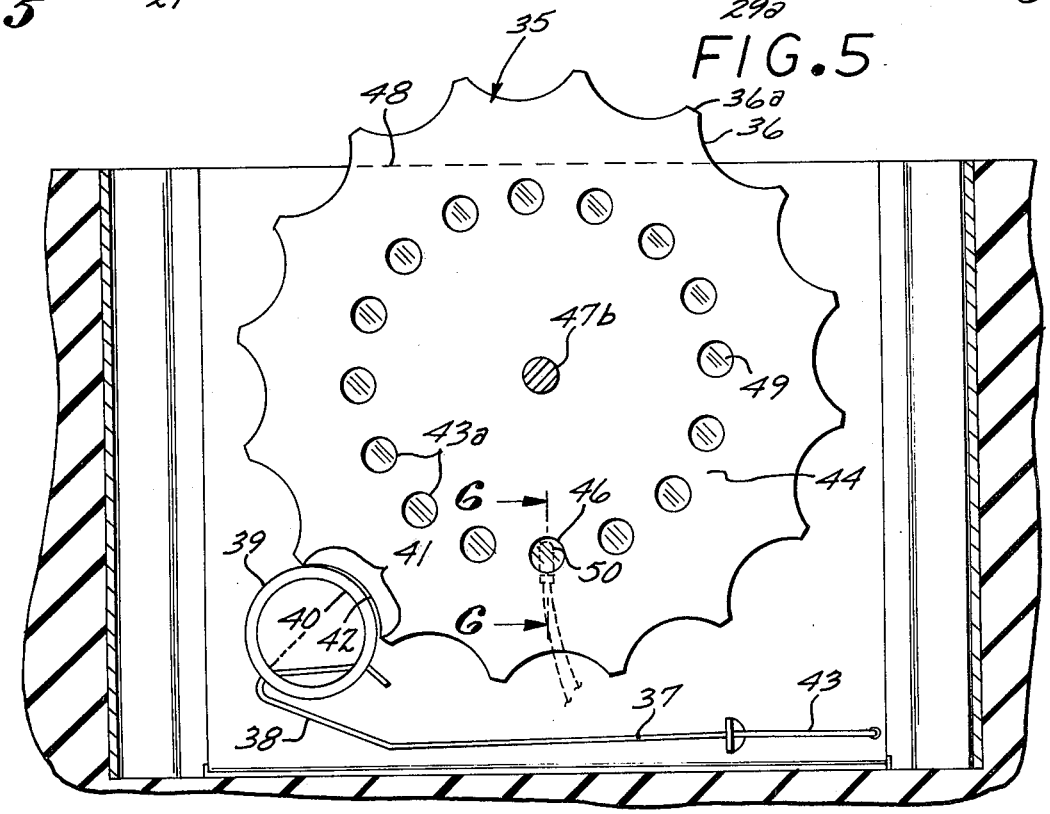

HEADS DOWN GOLF PRACTICE DEVICE

BACKGROUND OF THE INVENTION

1. Field of the Invention

This invention relates to golf practice devices to assist a golfer in disciplining himself to hold his head down while performing tee shots. The practice device provides a resilient tubular golf tee member mounted in and protruding upward from a resilient flat tee support structure base. The base includes a light means visible through the interior of the tubular golf tee and means for randomly selecting a color of the light. The base is placed by the golfer in a desired location, the golfer then places a golf ball on the tubular tee thereby covering the tee and the light. The golfer then selects a color randomly and is then ready to tee off. The golfer swings his golf club striking the ball and observing the light color as the ball leaves the tee after the club passes over the tee if his head, shoulders and eyes were properly oriented during the swing.

DISCUSSION OF PRIOR ART

An often heard criticism given a golfer after he has hit a ball off the tee and fails somehow to achieve the results he desired is "you didn't keep your head down". Golf instructors continually try to drive this concept home when they are teaching students how to tee off. Often the golfer himself truly believes he has kept his head down and his eye on the ball which was on the tee as he proceeds through the swing and strikes the ball with the club. A number of practice devices have been proposed to assist in training a golfer to hit the ball off the tee correctly. One such device entitled "A Programmed Swing Training Device" by R. Abel, Jr., U.S. Pat. No. 3,429,571 proposes a complicated mechanical means capable of regulating programmed body movements. Another device described in U.S. Pat. No. 3,610,633 by Samuel C. Schecter embodies the attachment of a golf ball means to the free end of a swingable arm which is mounted on a support means structure in a teed position. In the Schecter invention the golfer stands as he would on a golf course and practices striking the ball with his clubs. No provision is made whereby the golfer can actually observe whether or not his head and eyes were oriented properly, in a position where he is looking at the golf ball, at the instant the club strikes the ball on the tee.

The invention herein is a new and novel golf training device wherein the golfer in practicing his tee shots is able to know whether or not his head and eyes were properly oriented at the instant that the golf ball leaves the tee upon being struck by his swung club. The tee is a resilient tubular member mounted in a support structure base, said support structure base having a light means included therein which emits light through a light transparent internal portion of the tee and is visible to the golfer when he or she properly addresses the tee without a ball placed thereon. The base has mounted therein a color selecting light means for randomly selecting a color of light visible to the golfer. In use the golfer will place a golf ball atop the tubular tee thus covering the light. The golfer then randomly selects a light color by setting a color selector means and then swings the golf club striking the ball. At the instant the club passes over the tee, setting the ball in flight, he or she will observe the light if his or her head and eyes were positioned correctly with respect to the golf ball while the golf club was swung. The golfer's mind will register the color observed and, after the golf club swing is completed, the golfer can look back and reobserve the color shining through the tee to ascertain whether or not he or she observed the correct color and did in fact have his or her eyes on the golf ball as the club struck the ball and passed over the tee.

SUMMARY OF THE INVENTION

A primary object of this invention is to provide a simple and novel heads down golf training device which may be utilized by golfers to improve their tee shots.

Another object of this invention is to provide a resilient tubular golf tee mounted on a support structure having a light source shine through a light transparent tee interior portion which may be observed by a golfer in proper position to address a golf ball before placing a golf ball atop the tee, and after striking a teed golf ball with his club and after the golf ball and club have passed over the tubular tee, again permitting the golfer to observe the light.

Another important object of this invention is to provide a heads down practice device having a resilient hollow tubular tee member on a support structure wherein the hollow tubular tee may be used many times without being damaged upon being struck by a golf club.

Another important object of this invention is to provide a heads down golf practice device wherein the hollow tubular tee is mounted in a resilient support structural base so that if the golf club inadvertently strikes the base the club and base will not be damaged.

Another object of this invention is to provide a simple mechanical color changing means interposed between a light emitting source and a hollow interior of the hollow tubular tee to permit random selection of a light color emitted through the hollow interior of the tee which is visible to the golfer practicing with the device.

Another object of this invention is to provide a heads down golf practice device whereby the hollow resilient tubular tee may be easily replaced in the support structure base if the need arises.

Another object of this invention is to provide a novel color changing means for insertion into a support structure base which is of simple construction and easy to use so as to provide a device which is economically feasible, long lasting and relatively trouble free in operation.

Another object of this invention is to provide a heads down golf practicing device which is portable, easy to use, simply constructed, and long lasting and relatively trouble free in operation.

These and other objects will be apparent from the specification to one skilled in the art of golf practice device uses and manufacture.

BRIEF DESCRIPTION OF THE DRAWINGS

FIG. 1 is a prospective view showing a golfer using the heads down golf training device.

FIG. 2 is a top plan view of the heads down golf training device showing the hollow resilient tubular tee protruding from the top of the support structure and a portion of a color selecting wheel protruding from the edge of the support structure base.

FIG. 3 is a bottom plan view of the heads down golf practicing device showing a light assembly mounted in the base and a battery recess in the base for insertion of a battery therein for energizing a light in the light assembly (not shown).

FIG. 4 is a side-elevational view of the edge of the support structure base showing a color selecting light assembly inserted into the support structure base and oriented beneath the hollow tubular tee.

FIG. 5 is a cross sectional view showing the color wheel within a color selecting light assembly and a light source in a position beneath the hollow tubular golf tee member.

FIG. 6 is a cross sectional view showing a light bulb means mounted beneath the color selecting light assembly beneath the hollow resilient tubular golf tee member positioned so that the emitted light would shine through the hollow portion of the tee.

FIG. 7 is another embodiment as shown in FIG. 6 wherein the light source is adapted within a plug-in means plugged into a receiving socket within the support structure base.

DESCRIPTION OF THE PREFERRED EMBODIMENT

Figure 8:
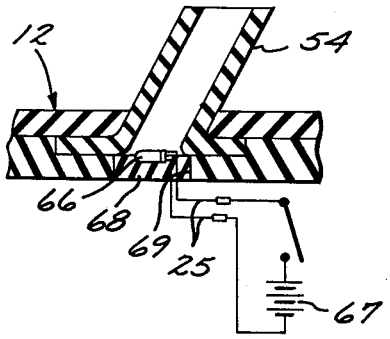
FIG. 8 is a cross sectional view of an embodiment of the invention showing a light bulb means and battery power source means without a color selecting means.

Referring to the drawings, a preferred embodiment of the present invention, a heads down golf training device 10, is described. The device 10 has a base 11 having a base upper surface 12 and a base lower surface 13. As shown in FIGS. 1 through 5 and 9 the base is rectangular in shape and as shown in FIGS. 10 and 11 the base is round. The base may be constructed of rubber, plastic, woven fabrics or other suitable material. The base upper surface 12 may be constructed having a flat regular surface or a grass turf simulating surface 88 as shown in FIG. 10. The materials of construction of the base should be resilient to avoid possible damage to a golf club if it is caused to inadvertently strike the base while the golfer practices with the device.

The base shown in FIGS. 1 through 7 has a light assembly holding first recess 14 formed therein extending upwardly from the lower surface 13 to a recess upper wall 15 and extending inwardly from a base outer edge 16 to a first recess inner wall 17. The first recess has a front guide slot 18 in a front wall recess 19 and a rear guide slot 20 in a rear wall recess, 21 which guide slots are located medially between the base lower surface 13 and the upper wall 15 and extend into the front and rear walls 19, 21 respectively, a relatively small distance. The base has a relatively small round tee insertion hole 22 extending from the base top surface 12 into the first recess 14. There is a battery holding second recess 23 extending upwardly from the base lower surface 13 having a battery connecting means 24 located therein and having insulated electrical wires 25 extending therefrom to an on-off switch means 26 located in a base front edge 27 and further extending therefrom and from said battery connecting means to a light connecting plug means 28 located medially in the first recess inner wall 17. The battery holding second recess 23, the insulated electrical wires 25 and the on-off switch means 26 may each be located in any other convenient position in the base such as that shown in FIG. 9 wherein the on-off switch means 26 is located in a base inner edge 71 with a switch toggle 72 extending outwardly therefrom, the battery holding second recess 70 being located adjacent thereto and wires 23 extending therefrom to the first recess inner wall 17.

The device 10 further has a color selecting assembly 29 insertable slip fittingly into the first recess 14 guide slots 18, 20. The color selecting assembly 29 has a color wheel carriage **29*a* comprising an upper plate 30 and a lower plate 31, said lower plate being slip fittingly slidably inserted into upperplate grooves 32 formed at a front edge 33 and a rear edge 34 of the upper plate. An indexable color lens carrying wheel 35 is rotatably mounted between upper and lower plates 30, 31 in a relatively narrow space therebetween. The color lens carrying wheel 35 shown has a scalloped periphery 36 providing an indexing arrangement with a wheel positioning indexing spring means 37, said spring means having fixedly and movably connected thereto on a front end 38 a circular ring member 39, said ring member having a diameter 40 such that a ring peripheral portion 41 meshes with a wheel scallop 32 when the wheel 35 is positioned in wheel indexed position as shown in FIG. 5. The spring means is fixedly connected at a rearward end 43 to lower plate 31**.

A series of equidistantly spaced holes **43*a* are arranged circularly around a wheel inner portion 44 and the circular arrangement is concentric with a wheel periphery 36*a*. The upper and lower plates 30, 31 each have a relatively small light transmission hole 45 therein located to align with a circular colored lense carrying hole 46 in the wheel 35 when the wheel is indexed properly and further in alignment with the tee insertion hole 22 in the base when the color selecting assembly 29 is slidably inserted in place into the base first recess 14. The wheel 35 is rotatably mounted between the upper and lower plates 30, 31 by pin means 47 inserted through wheel mounting holes 47*a* in the upper and lower plates 30, 31 and a wheel central mounting hole 47*b* in the wheel 35. A wheel manipulting portion 48 extends out of the wheel carriage 29. Each of the said holes 43*a* in the wheel 35 has a transparent colored lens 49 inserted therein. The colors of the lenses are selected to assure random selection when the color wheel 35 is rotated. A small light bulb means 50 is fixedly attached by a light bulb holding means to the bottom plate 31 on a lower surface 51 thereof in alignment with the light hole 45 in the lower plate. The light bulb means 50 has a plurality of insulated wires 52 extending therefrom adapted with connectors 53 to connect to the light connecting plug means 28 in the base. The color selecting assembly 29, including the color wheel carriage 29*a*, the color wheel 35, the circular ring member 39 and wheel mounting pin means 47 may be constructed of any structurally rigid material including metals, rigid plastics, and the like. The spring means 37 may be constructed of any suitable resilient spring material. The colored lens 49 may be constructed of any suitable colored transparent material preferably of plastics such as thin adhesively backed mylar films for adhesively bonding the lens material to a color wheel 35 surface over the colored lens carrying holes 46. Thicker lenses may be fixedly inserted into said holes 46.**

A tubular resilient golf tee 54 is provided for slip fitting insertion into the base tee hole 22. The tee 54 has a base tee hold retaining flange 55 integral with a tee lower end 56 for retaining the inserted tee 54 within the base tee hole 22. The tee 54 is open at a top end 57 and at the bottom end 56 to permit light to be seen through a tee central interior portion 58. The top end 57 of the inserted tee is upwardly disposed from the base upper surface 12 a distance suitable for teeing a golf ball 59 (see FIG. 1) above the base upper surface 12.

The tee is provided with an angle 60 between a top flange surface 61 and a tubular tee golfer side 62 within the range of from 45° to 90°, the precise angle is determined by the height of the golfer using the training device, but it has been found that for average golfer heights an angle of 67.5° is suitable. The tee top end 57 is formed at an angle such that a tee top surface 63 is horizontal and substantially parallel to the base upper surface 12 when the tee is inserted in the base hole 22 ready for use.

The tee 54 may be constructed of any suitable material having capability of supporting a golf ball 59 placed atop the tee 54, and which will allow the tee to resiliently return to the original structural dimensions and to its correct position after the golf ball and/or tee is struck by the golf club. Suitable materials for tee construction include rubber, neoprene (synthetic rubber), plastics having suitable resiliency and structural strength, plastics and other like materials. The tee may be hollow as is the case of the preferred embodiment or it may be solid having a light opaque wall enclosing a light transmissible resilient and flexible material.

FIG. 7 shows a cross-sectional view of a light plug-in module 66 adapted to be detachably attached to the bottom plate 31 having a light bulb means 50 mounted in said module 66 and in alignment with the lower plate hole 45, said module being further adapted to plug into light plug means 67 in the base 11 first recess 14 inner wall 17.

Figure 12:
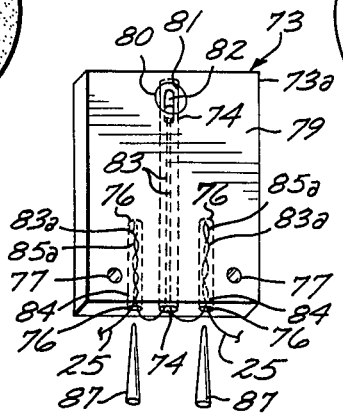
FIG. 12 shows a plan view of a detachable lightholding assembly for the color selecting assembly.

FIG. 12 shows a plan view of a light holding member 73 adapted to be boltably and detachably attached to the lower plate 31 of said light color selecting member 29. The light holding member 73 is constructed of any of the class of non-electrical conductors comprising plastics, insulation covered metals, and the like and may be any size or shape which is adaptable to being attached to said color selecting assembly 29 when inserted into said base 11. The member shown in FIG. 12 comprises a relatively thin cube 73*a* having a central light insertion hole 74 extending into but not through said cube 73*a* from a light connecting edge 75 and having on each side of said central hole 74 in said edge a light wire connecting insertion hole 76. The said member 73 further has a plurality of bolt holes 77 extending through the cube 73*a* from a bottom cube surface 79. A light emission hole 80 extends from the top cube surface 79 into the central hole 74, at or near the central hole end 81. In use, the light holding member 73 has inserted into the central hole 74 a high intensity light bulb means 82 having a plurality of insulated electrical bulb-connecting wires 83 extending therefrom and out of the central 74. The insulation is removed from each wire connecting end 84 and from insulated wire ends 85*a*, 85*b* of the insulated wires 25 extending from the battery connecting means 24 and light switch means 26. One wire end 85*a* is twisted together with a light wire end 83*a* and the other wire end 85*b* is twisted together with the other light wire end 83*b*, twisted wire ends 85*a*–83*a*, 85*b*–83*b* are then inserted into a light wire connecting insertion hole 76 (one set of twisted wires for each hole 76.) Thereafter a wedge means 87 is inserted detachably into each of said wire connecting insertion holes 76. The cube 73 is then bolted to the lower plate 31 with bolt means through each of said bolt holes 77 positioned on said lower plate to provide alignment of the light emission hole 80 with the light transmission hole 45 in the said lower plate 31.

Another embodiment is shown in FIGS. 8, 9, 10 and 11. The device shown does not have a color lens carrying wheel 35, but has only a light bulb means 66 mounted within the base tee insertion hole 22. A tee member 54 is fixedly removably inserted into said base tee insertion hole. An electrical energy means 67 is provided together with required interconnecting wiring 25. The light bulb means 66 is mounted on a removable light plug-in assembly 68 being insertable into a light plug-in assembly first recess 69 extending upwardly into the base 11 from the base lower surface 13. A battery holding second recess 70 is provided in the base 11 extending upwardly from the base lower surface into the base for insertion thereinto a battery means and connecting the battery means to a battery terminal connecting means 24 and to an on-off electrical switch 26 mounted in a base edge 71.

Figure 9:
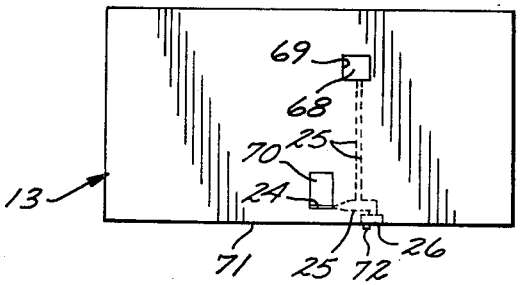
FIG. 9 is a plan view of an embodiment showing a removable light means inserted into a light holding first recess, a battery inserted into a battery holding second recess and an on-off switch together with interconnecting wiring.
Figure 10:
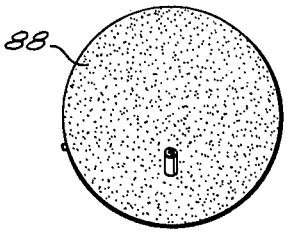
FIG. 10 shows a top plan view of an embodiment having a circular base.
Figure 11:
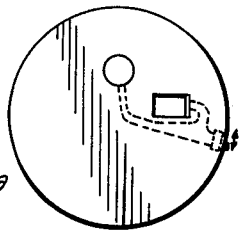
FIG. 11 shows a bottom plan view of an embodiment having a circular base having removable light bulb means inserted in a bulb means holding first recess, a battery inserted in a battery holding second recess and an on-off switch together with interconnecting wiring.

FIGS. 10 and 11 are identical embodiments as shown in FIGS. 8 and 9 excepting the base which is circular and the embodiment shown has an irregular grass turf simulating top surface 88.

OPERATION

A hollow tubular golf tee 54 having an angle 60 suitable for the golfer is inserted into the base tee hole 22. The assembled color selecting assembly carriage 29 is inserted within the base light means holding recess 14, a battery is connected to the battery connecting means 24 and inserted into the battery holding recess 23. The light bulb 50 is then connected to the connectors 53. The color wheel manipulating portion 48 extends from the base 12 outer edge 16 when the device 10 is thus assembled.

The golfer 64, shown in FIG. 1 in golf ball addressing position, places the heads down golf training device 10 in a desired position in front of the golfer, base lower surface 13 down on a flat surface setting indoors or outdoors. The golfer switches the on/off switch 26 to the "on" position thereafter observing the light through the tee hollow portion 58. The golfer then places a golf ball 59 on top of the tee 54 in teed position and then rotates the colored lense carrying wheel 35 to a new indexed position. The golfer then takes the correct golf stance for hitting the golf ball 59 off the tee and swings the golf club 65.

The color of the light shining through the tee hollow portion will have been observed by the golfer as the club passes over the tee — if the golfer had held his head down and had looked at the ball until the club passed over the top of the tee. After the swing is completed, the golfer then re-observes the light color to check whether or not he or she actually had observed the correct light after the club passed over the golf tee and thereby prove that the golfer's head had been held down until after the club passed over the tee.

While the preferred embodiment utilizes a color selecting means 29, the invention also includes provisions for a light of any color desired without a color selecting means. This arrangement is obvious from FIGS. 6 and 7 by eliminating the lower plate 31 and the color selecting wheel 35 and by mounting the light 50 on the upper plate 30 in position within the upper plate light hole 45 so that the light shines through the tee hollow portion 58.

I claim as my invention:

1. A golf practicing device comprising in combination:

a. a base including an upper surface and a lower surface and a peripheral edge;

b. a resilient tee member having a lower end fixedly attached to said base, an opaque wall extending upwardly from said lower end to a top end for teeing a golf ball thereon, said opaque wall defining therewithin a light transmitting interior having a light exit at the top thereof and a light entrance at the lower end thereof;

c. a light emitting assembly mounted on said base comprising a light bulb mounted in said base in alignment with said light entrance for emitting light upwardly through the interior of said tee and out through said light exit, an electrical energy source means, and electrical wiring means electrically interconnecting said energy source means and said light bulb to cause the latter to emit light to the interior of said tee, which light is visible to a golfer when a ball is not present on said tee member, d. a carriage mounted in said base, said carriage being formed with apertures aligned with said light bulb, and e. a wheel rotatably mounted in said carriage, a peripheral portion of said wheel being exposed exteriorly of said base for rotation by the golfer, said wheel being provided with a plurality of transparent lenses of varying colors spaced circumferentially around said wheel and adapted to be rotated in sequence to align said lenses with said apertures in said carriage whereby the light from said light bulb is transmitted upwardly through the selected lens to said tee interior for visual detection by the golfer when a golf ball is not positioned on said tee, and mean operatively interconnected between said carriage and said wheel for permitting rotative indexing of said wheel relative to said carriage and retention of said wheel in such indexed position, whereby a golfer can first position a ball on said tee, thereafter index said wheel to present a lens of unknown color to a position above said bulb, briefly glimpse the colored light as the ball is struck from the tee, and re-observe such colored light at the completion of his swing.

2. The combination of claim 1 wherein the base has therein a. first recess defined by a peripheral wall in which is mounted a light bulb connecting means, said light bulb being connected to said light bulb connecting means;

b. a battery insertion recess in said base having a battery terminal connecting means therein, battery means removably inserted in said battery recess and connected to said battery terminal connecting means and c. an on-off light switch exposed at the exterior of said base, said switch, battery connecting means and light bulb connecting means being interconnected with a plurality of electrically conductive wires adapted to conduct electrical energy from said battery means to the light bulb.

3. The combination of claim 1 wherein the base is formed with a. a first recess for said light assembly, said recess opening out of the base lower surface and extending upwardly therefrom and inwardly from the outer edge of the base to a first recess inner wall, said first recess being in light transparent communication with said tee light entrance and receiving said light emitting assembly whereby said light bulb can be aligned with said light entrance;

b. a battery holding second recess extending upwardly from the base lower surface and opening thereoutof, said second recess having a battery terminal connecting means therein for connecting a battery thereto upon inserting a battery means into said second recess, an on-off light switch in the base and exposed exteriorly thereof, and d. a plurality of wires enclosed within the base and interconnecting the light switch, the battery terminal connecting means, and said light bulb for controllably conducting electrical energy from the battery means to said light bulb.

4. The combintion of claim 1 wherein said carriage comprises a top plate and a bottom plate defining therebetween a color wheel mounting recess, light transmission holes through the top and bottom plates, opposed edges of said carriage being slidably and removably inserted into guide slots formed in said base, said transparent colored lenses being mounted circularly around a wheel inner portion and being in concentric arrangement with the outer circumference of said wheel.

5. The combination of claim 4 wherein said wheel has a scalloped outer periphery, one scallop for each of the plurality of colored lenses mounted in said wheel; a scallop positioning indexing spring means, said spring means having fixedly and movably connected thereto at one end thereof a circular ring member, said ring member having a diameter such that the ring meshes with a wheel scallop when the wheel is positioned in a selected indexed position wherein a color lens is in alignment with the carriage apertures and the tee light entrance, said spring means being fixedly connected at its other end to the carriage thereby to force the circular ring member resiliently against said wheel.

6. The combination set forth in claim 4 wherein said top and bottom plates and said wheel are formed with aligned pin openings, and pin means extending through said openings for rotatably mounting said wheel between said plates.

7. The combination of claim 4 wherein said light bulb is enclosed in a module means, said module means being removably attached to the lower surface of said lower plate, said light bulb being in alignment with the light transmission hole in said lower plate, said module means having plug-in means for insertion thereof into an electrical energy source receptacle in the wall of said base.

8. The combination set forth in claim 4 wherein said light bulb is enclosed in a member comprising a relatively thin cube of an electrically non-conductive material adapted to be detachably mounted to said lower plate, said member having a central light bulb insertion hole extending into but not through said cube and having a plurality of wire connecting holes, one on each side of said central hole, said wire connecting holes extending into but not through said cube, said cube further having a plurality of bolt holes extending through said cube, said light bulb having insulated wires extending therefrom and electrically conductively connected to wires of an electrical energy source; the wires of said energy source and said light bulb having insulation removed from the ends thereof, which ends are twistably connected together and inserted into the wire connecting holes, one twisted pair for each of said wire connecting holes, wire holding wedge members inserted into said holes for assuring electrical conductivity of said twisted wire ends and mechanically holding said twisted wire ends in said wire connecting holes, said cube thereafter being attached to said lower plate thereby aligning the light transmission hole in the cube with the light transmission hole in the lower plate, the lens in said carrying wheel and the upper plate light transmission hole.

9. A golf practicing device comprising in combination:

a. a base including an upper surface and a lower surface and a peripheral edge;

b. a resilient tee member having a lower end fixedly attached to said base, an opaque wall extending upwardly from said lower end to a top end disposed above the base for teeing a golf ball thereon, said opaque wall defining therewithin a light transmitting interior having a light exit at the top thereof and a light entrance at the lower end thereof;

c. a light bulb mounted in said base in alignment with said light entrance for emitting light upwardly through the interior of said tee and out through said light exit, an electrical energy source means, and electrical wiring means for conducting electrical energy from said energy source means to said light bulb to cause the latter to emit light to the interior of said tee, which light is visible to the golfer when a ball is not present on said tee member, d. a wheel having a plurality of transparent lenses of varying colors concentrically spaced around said wheel, e. means for mounting said wheel for rotation in said base whereby said wheel can be rotatably indexed to sequentially align each lens with said light bulb and the interior of said tee, and f. means for releasably retaining said wheel in each indexed position, whereby a golfer can first position a ball on said tee, thereafter index said wheel to present a lens of unknown color to a position above said light bulb, briefly glimpse the colored light as the ball is struck from the tee, and re-observe such colored light at the completion of his swing.

10. The combination of claim 9 wherein said means for mounting said wheel in said base comprises a carriage having a top and bottom plate mounted in guide slots in said base, pin means for rotatably mounting said wheel between said top and bottom plates for rotation relative thereto, said plates being formed with apertures aligned with said light bulb and said light entrance, whereby each lens in said wheel can be sequentially indexed into alignment with said aperture and said light bulb and releasably retained in such position.

* * * * *